US012171258B2

(12) United States Patent
Cheong et al.

(10) Patent No.: US 12,171,258 B2
(45) Date of Patent: Dec. 24, 2024

(54) AEROSOL GENERATION ARTICLE

(71) Applicant: KT&G CORPORATION, Daejeon (KR)

(72) Inventors: Bong Su Cheong, Daejeon (KR); Dong Kyun Ko, Sejong (KR); Jae Sung Noh, Cheonan-si (KR); Sang Won Choi, Daejeon (KR); Jung Seop Hwang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 183 days.

(21) Appl. No.: 16/966,563

(22) PCT Filed: Nov. 15, 2019

(86) PCT No.: PCT/KR2019/015611
§ 371 (c)(1),
(2) Date: Jul. 31, 2020

(87) PCT Pub. No.: WO2020/111607
PCT Pub. Date: Jun. 4, 2020

(65) Prior Publication Data

US 2020/0359677 A1 Nov. 19, 2020

(30) Foreign Application Priority Data

Nov. 30, 2018 (KR) ..... 10-2018-0153011

(51) Int. Cl.
*A24D 1/20* (2020.01)
*A24D 1/02* (2006.01)
*A24D 3/17* (2020.01)

(52) U.S. Cl.
CPC ..... *A24D 1/20* (2020.01); *A24D 1/02* (2013.01); *A24D 3/17* (2020.01)

(58) Field of Classification Search
CPC ... A24D 1/20; A24D 1/02; A24D 3/17; A24D 3/06
See application file for complete search history.

(56) References Cited

U.S. PATENT DOCUMENTS 10,045,562 B2 8/2018 Buchberger
10,159,277 B2 12/2018 Bonnely
(Continued)

FOREIGN PATENT DOCUMENTS

CN 103987285 A 8/2014
CN 104203015 A 12/2014
(Continued)

OTHER PUBLICATIONS

International Search Report for PCT/KR2019/015611, dated Feb. 25, 2020.
(Continued)

*Primary Examiner* — Michael H. Wilson
*Assistant Examiner* — Stephanie Lynn Moore
(74) *Attorney, Agent, or Firm* — Sughrue Mion, PLLC

(57) ABSTRACT

An aerosol-generating article according to one embodiment includes a medium portion; a first hollow tube disposed to face a downstream end of the medium portion and including a first hollow; a cooling portion disposed next to a downstream side of the first hollow tube, including a second hollow tube including a second hollow having a diameter equal to or greater than a diameter of the first hollow and a cooling element; a filter portion disposed to face the downstream end of the cooling portion; and a wrapper wrapping at least a portion of the medium portion, the first hollow tube, the cooling portion, and the filter portion.

4 Claims, 4 Drawing Sheets

(56) References Cited

U.S. PATENT DOCUMENTS

| | | | | |
|---|---|---|---|---|
| 11,140,916 | B2 | 10/2021 | Zuber et al. | |
| 2010/0154808 | A1* | 6/2010 | Boll | A24D 1/00 131/365 |
| 2010/0294290 | A1* | 11/2010 | Zhang | A24B 15/283 264/129 |
| 2014/0158144 | A1* | 6/2014 | Kaljura | A24D 3/043 131/336 |
| 2015/0181929 | A1 | 7/2015 | Lisan et al. | |
| 2016/0174609 | A1 | 6/2016 | Mironov | |
| 2016/0192704 | A1* | 7/2016 | Bonnely | A24D 1/027 131/329 |
| 2016/0295926 | A1* | 10/2016 | Zuber | A24F 42/10 |
| 2016/0316816 | A1 | 11/2016 | Lavanchy et al. | |
| 2017/0042243 | A1 | 2/2017 | Plojoux et al. | |
| 2018/0007973 | A1* | 1/2018 | Thorens | A24F 40/42 |
| 2018/0177235 | A1 | 6/2018 | Minzoni | |
| 2018/0235283 | A1 | 8/2018 | Zuber et al. | |
| 2019/0075845 | A1 | 3/2019 | Malgat et al. | |
| 2020/0154776 | A1 | 5/2020 | Lee et al. | |

FOREIGN PATENT DOCUMENTS

| | | | |
|---|---|---|---|
| EP | 3 178 333 | A1 | 6/2017 |
| JP | 2016-531572 | A | 10/2016 |
| KR | 10-2003-0093631 | A | 12/2003 |
| KR | 10-2015-0038392 | A | 4/2015 |
| KR | 10-2016-0042417 | A | 4/2016 |
| KR | 10-1616664 | B1 | 4/2016 |
| KR | 10-2017-0008726 | A | 1/2017 |
| KR | 10-2017-0041797 | A | 4/2017 |
| KR | 10-2018-0020136 | A | 2/2018 |
| KR | 10-2018-0070436 | A | 6/2018 |
| KR | 10-2018-0118767 | A | 10/2018 |
| WO | 2017/153443 | A1 | 9/2017 |

OTHER PUBLICATIONS

Extended European Search Report issued Dec. 10, 2021 in European Application No. 19890461.7.

Communication dated Mar. 26, 2021 from the Korean Intellectual Property Office in Application No. 10-2018-0153011.

Notice of Reasons for Refusal dated Jun. 22, 2021 from the Japanese Patent Office in JP Application No. 2020-542300.

Office Action issued Dec. 22, 2022 in Chinese Application No. 201980010963.0.

* cited by examiner

AEROSOL GENERATION ARTICLE

CROSS REFERENCE TO RELATED APPLICATIONS

This application is a National Stage of International Application No. PCT/KR2019/015611 filed Nov. 25, 2019, claiming priority based on Korean Patent Application No. 10-2018-0153011 filed Nov. 30, 2018.

TECHNICAL FIELD

The present invention relates to an aerosol-generating article, and more particularly, to an aerosol-generating article including a cooling portion including a cooling element and a hollow tube.

BACKGROUND ART

Recently, the demand for alternative methods to overcome the shortcomings of general aerosol-generating articles has increased. For example, there is growing demand for a method of generating aerosol by heating an aerosol-generating material in aerosol-generating articles, rather than by combusting aerosol-generating articles. Accordingly, studies on a heating-type aerosol-generating article and a heating-type aerosol-generating device have been actively conducted.

The aerosol-generating article may include a cooling element for cooling aerosol to below a certain temperature. The cooling element has the advantage of allowing a user to safely inhale the aerosol, but also has the disadvantage of increasing a cost of the aerosol-generating article due to the high manufacturing cost. Accordingly, research has been conducted to reduce the cost while maintaining a cooling function of the aerosol-generating article.

DESCRIPTION OF EMBODIMENTS

Technical Problem

The present invention is to provide an aerosol-generating article capable of reducing a cost while maintaining a cooling function. The technical problem to be solved is not limited to the technical problem as described above, and other technical problems may exist.

Solution to Problem

An aerosol-generating article according to one embodiment includes a medium portion; a first hollow tube disposed to face a downstream end of the medium portion and including a first hollow; a cooling portion disposed next to a downstream side of the first hollow tube, including a second hollow tube including a second hollow having a diameter equal to or greater than a diameter of the first hollow and a cooling element; a filter portion disposed to face the downstream end of the cooling portion; and a wrapper wrapping at least a portion of the medium portion, the first hollow tube, the cooling portion, and the filter portion.

Advantageous Effects of Disclosure

According to the present invention, a manufacturing cost may be reduced while maintaining aerosol ingredient delivery function and a cooling function of the aerosol-generating article. Effects of the present invention are not limited by the contents exemplified above, and more various effects are included in the present specification.

BEST MODE

Figure 1:
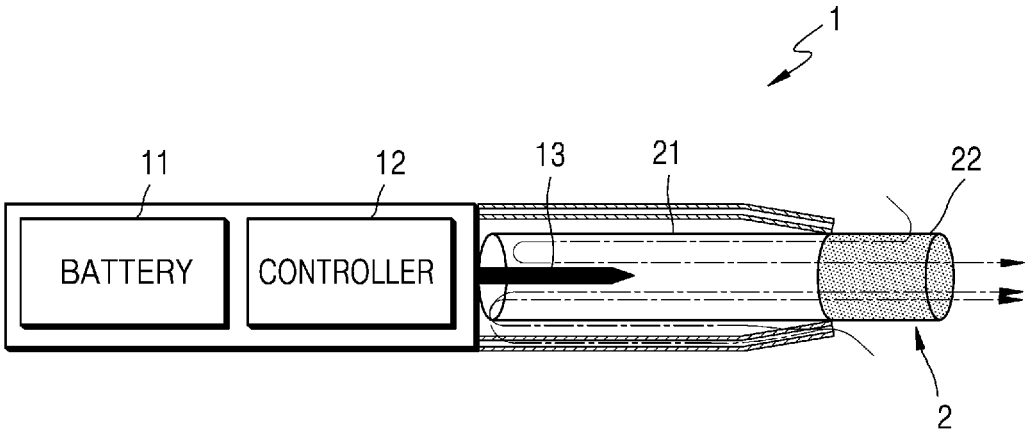
FIG. 1 is a diagram illustrating that an aerosol-generating article is inserted into an aerosol-generating device.

An aerosol-generating article according to one embodiment includes a medium portion; a first hollow tube disposed to face a downstream end of the medium portion and including a first hollow; a cooling portion disposed next to a downstream side of the first hollow tube, and including a cooling element and a second hollow tube including a second hollow having a diameter equal to or greater than a diameter of the first hollow; a filter portion disposed to face the downstream end of the cooling portion; and a wrapper wrapping at least a portion of the medium portion, the first hollow tube, the cooling portion, and the filter portion.

In the aerosol-generating article described above, a length of the second hollow tube is shorter than a length of the first hollow tube.

In the aerosol-generating article described above, a length of the second hollow tube and a length of the cooling element are included within a range of 4 mm to 10 mm, respectively.

In the aerosol-generating article described above, each of the cooling element and the second hollow tube is wrapped by a wrapper, and the wrapped cooling element and the wrapped second hollow tube are rewrapped by a single wrapper.

In the aerosol-generating article described above, the cooling element is wrapped by a wrapper, and the wrapped cooling element and the second hollow tube are wrapped by a single wrapper.

In the aerosol-generating article described above, the first hollow tube and the second hollow tube include cellulose acetate.

In the aerosol-generating article described above, the cooling element includes a polymer fiber.

In the aerosol-generating article described above, the cooling element and the second hollow tube are sequentially arranged downstream.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, some terms are arbitrarily selected by the applicant, and in this case, their meanings will be described in detail in the description of an invention. Therefore, the terms used in the present invention should be defined based on meanings of the terms and contents of the present invention, not simply names of the terms.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In the following embodiments, with respect to the terms "upstream" and "downstream", when a user inhales air using a smoking article, a portion in which air enters into an aerosol-generating article from the outside is referred to as "upstream", and a portion in which air exits from inside the aerosol-generating article to the outside is referred to as "downstream". The terms "upstream" and "downstream" are terms used to indicate a relative position or direction between the segments that constitute the aerosol-generating article.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present invention will be described in detail with reference to the drawings.

FIG. 1 is a diagram illustrating an example in which an aerosol-generating article is inserted into an aerosol-generating device.

Referring to FIG. 1, the aerosol-generating device 1 may include a battery 11, a controller 12, and a heater 13. Also, the aerosol-generating article 2 may be inserted into an inner space of the aerosol-generating device 1.

FIG. 1 shows the aerosol-generating device 1 with some elements related to the present embodiment. Therefore, it will be understood by one of ordinary skill in the art that other general-purpose components may be further included in the aerosol-generating device 1, in addition to the components illustrated in FIG. 1.

FIG. 1 illustrates that the battery 11, the controller 12, and the heater 13 are arranged in series, but the arrangement of these are not limited thereto. In other words, according to the design of the aerosol-generating device 1, the arrangement of the battery 11, the controller 12, and the heater 13 may be modified.

When the aerosol-generating article 2 is inserted into the aerosol-generating device 1, the aerosol-generating device 1 heats the heater 13. The temperature of an aerosol-generating material in the aerosol-generating article 2 is raised by the heated heater 13, and thus aerosol is generated.

As necessary, even when the aerosol-generating article 2 is not inserted into the aerosol-generating device 1, the aerosol-generating device 1 may heat the heater 13.

The battery 11 may supply power to be used for the aerosol-generating device 1 to operate. For example, the battery 11 may supply power for heating the heater 13 and supply power for operating the control unit 12. Also, the battery 11 may supply power for operations of a display, a sensor, a motor, etc. mounted in the aerosol-generating device 1.

The controller 12 may control overall operations of the aerosol-generating device 1. In detail, the controller 12 controls not only operations of the battery 11 and the heater, but also operations of other components included in the aerosol-generating device 1. Also, the controller 12 may check a state of each of the components of the aerosol-generating device 1 to determine whether or not the aerosol-generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 is heated by power supplied from the battery 11. For example, when the aerosol-generating article 2 is inserted into the aerosol-generating device 1, the heater 13 may be located inside the aerosol-generating article 2. Thus, the heated heater 13 may increase a temperature of an aerosol-generating material in the aerosol-generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol-generating device 1 or may be set as a temperature desired by a user.

As another example, the heater 13 may include an induction heater. In detail, the heater 13 may include an electrically conductive coil for heating an aerosol-generating article in an induction heating method, and the aerosol-generating article may include a susceptor which may be heated by the induction heater.

The heater 13 is inserted into the aerosol-generating article 2 in FIG. 1, but it is not limited thereto. For example, the heater 13 may include a tube-type heating element, a plate-type heating element, a needle-type heating element, or a rod-type heating element, and may heat the inside or the outside of the aerosol-generating article 2, according to the shape of the heating element.

Also, the aerosol generating device 1 may include a plurality of heaters 13. Here, the plurality of heaters 13 may be inserted into the aerosol-generating article 2 or may be arranged outside the aerosol-generating article. Also, some of the plurality of heaters 13 may be inserted into the aerosol-generating article 2, and the others may be arranged outside the aerosol-generating article. In addition, the shape of the heater 13 is not limited to the shapes illustrated in FIG. 1 and may include various shapes.

The aerosol-generating device 1 may further include general-purpose components in addition to the battery 11, the controller 12, and the heater 13. For example, the aerosol-generating device 1 may include a display capable of outputting visual information and/or a motor for outputting haptic information. Also, the aerosol-generating device 1 may include at least one sensor (a puff detecting sensor, a temperature detecting sensor, an aerosol-generating article insertion detecting sensor, etc.).

Also, the aerosol-generating device 1 may be formed as a structure where, even when the aerosol-generating article 2 is inserted into the aerosol-generating device 1, external air may be introduced or internal air may be discharged.

Although not illustrated in FIG. 1, the aerosol-generating device 1 and an additional cradle may form together a system. For example, the cradle may be used to charge the battery 11 of the aerosol-generating device 1. Alternatively, the heater 13 may be heated while the cradle and the aerosol-generating device 1 are coupled to each other.

The aerosol-generating article 2 may be similar to a general combustive aerosol-generating article. For example, the aerosol-generating article 2 may be divided into a first portion 21 including an aerosol-generating material and a second portion 22 including a filter or the like. The second portion 22 of the aerosol-generating article 2 may also include an aerosol-generating material. For example, an aerosol-generating material made in the form of granules or capsules may be inserted into the second portion 22.

The first portion 21 may be completely inserted into the aerosol-generating device 1, and the second portion 22 may be exposed to the outside. In some embodiments, only a portion of the first portion 21 may be inserted into the aerosol-generating device 1. Otherwise, a portion of the first portion 21 and a portion of the second portion 22 may be inserted into the aerosol-generating device 1. The user may puff aerosol while holding the second portion 22 by the mouth of the user. In this case, the aerosol is generated by the external air passing through the first portion 21, and the generated aerosol passes through the second portion 22 and is delivered to the user's mouth.

For example, the external air may flow into at least one air passage formed in the aerosol-generating device 1. For example, opening and closing of the air passage and/or a size of the air passage may be adjusted by the user. Accordingly, the amount and quality of vapor may be adjusted by the user. As another example, the external air may flow into the aerosol-generating article 2 through at least one hole formed in a surface of the aerosol-generating article 2.

Hereinafter, an example of an aerosol-generating article will be described with reference to FIGS. 2 and 3.

Figure 2:
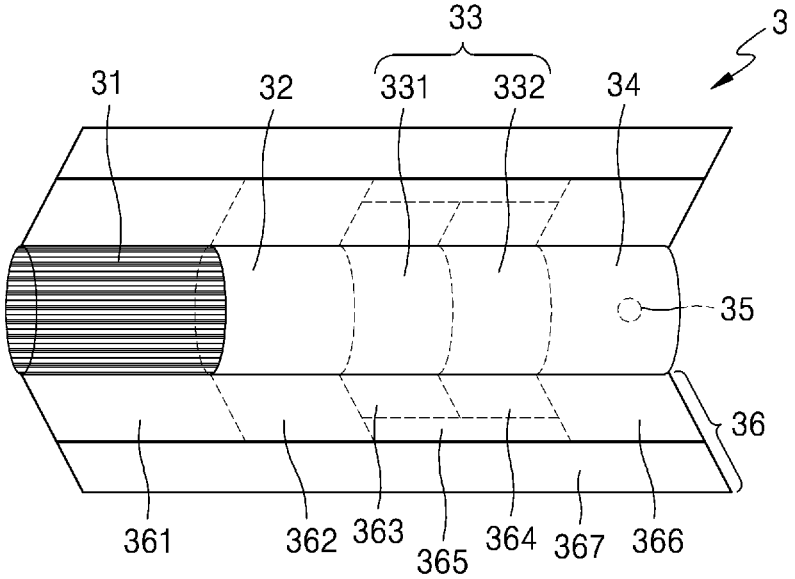
FIGS. 2 to 4 are diagrams illustrating examples of an aerosol-generating article.
Figure 3:
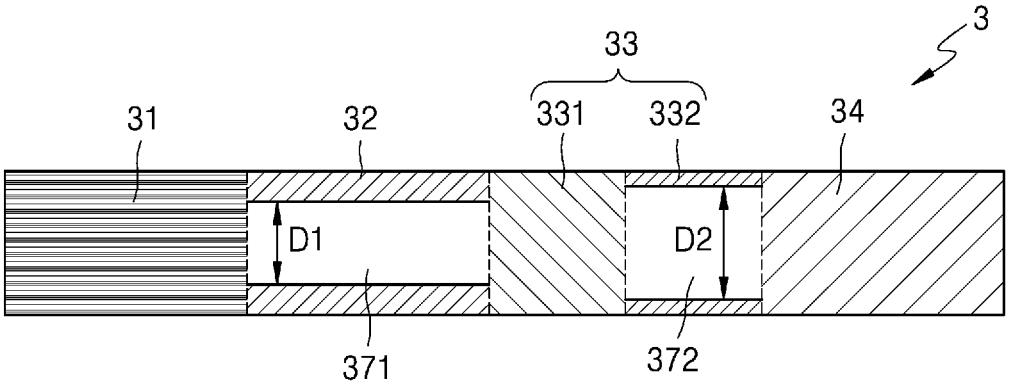

FIGS. 2 and 3 are diagrams showing an example of an aerosol-generating article.

FIGS. 2 and 3, the aerosol-generating article 3 includes a medium portion 31, a first hollow tube 32, a cooling portion 33, and a filter portion 34. The first portion 21 described above with reference to FIG. 1 includes the medium portion 31, and the second portion 22 includes the first hollow tube 32, the cooling portion 33, and the filter portion 34.

The medium portion 31 may include an aerosol-generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the medium portion 31 may include other additives, such as flavors, a wetting agent, and/or organic acid. Also, the medium portion 31 may include a flavored liquid, such as menthol or a moisturizer, which is injected to the medium portion 31.

The medium portion 31 may be manufactured in various forms. For example, the medium portion 31 may be formed using sheets or strands. Also, the medium portion 31 may be formed using tiny bits cut from a tobacco sheet.

Also, the medium portion 31 may be surrounded by a heat conductive material. For example, the heat-conducting material may be, but is not limited to, a metal foil such as aluminum foil. For example, the heat conductive material surrounding the medium portion 31 may uniformly distribute heat transmitted to the medium portion 31, and thus, the heat conductivity of the medium portion may be increased and taste of the tobacco may be improved. Also, the heat conductive material surrounding the medium portion 31 may function as a susceptor heated by the induction heater. Here, although not illustrated in the drawings, the medium portion 31 may further include an additional susceptor, in addition to the heat conductive material surrounding the medium portion 31.

The first hollow tube 32 may be a cellulose acetate filter. The first hollow tube 32 may be a tube-shaped structure including the first hollow 371 therein. In other words, the first hollow tube 32 includes a first hollow 371 having a diameter D1, and the first hollow 371 may serve as a channel through which aerosol passes. A length of the first hollow tube 32 may be an appropriate length within a range of 4 mm to 30 mm, but is not limited thereto. Preferably, the length of the first hollow tube 32 may be 10 mm, but is not limited thereto. The diameter D1 of the first hollow 371 may be an appropriate diameter within the range of 2 mm to 4.5 mm, but is not limited thereto. Preferably, the diameter (D1) of the first hollow tube 32 may be 3.4 mm, but is not limited thereto.

The cooling portion 33 cools the aerosol generated by a heater 13 heating the medium portion 31. The cooling portion 33 includes a cooling element 331 and a second hollow tube 332.

A length or diameter of the cooling portion 33 may be variously determined according to a shape of the aerosol-generating article 300. For example, the length of the cooling portion 33 may be a suitable length within a range of 7 mm to 20 mm. Preferably, the length of the cooling portion 33 may be about 14 mm, but is not limited thereto.

The cooling element 331 may cool the aerosol by a phase transition action. For example, a material forming the cooling element 331 may perform the phase transition action, such as melting or glass transition, which requires absorption of thermal energy. As an endothermic reaction occurs at a temperature at which an aerosol enters the cooling element 331, a temperature of the aerosol passing through the cooling element 331 is lowered.

The length of the cooling element 331 may be a suitable length within the range of 4 mm to 10 mm. Preferably, the length of the cooling element 331 may be about 7 mm, but is not limited thereto.

As an example, the cooling element 331 may be made of a polymer material or a biodegradable polymer material alone. Here, examples of the polymer material includes, gelatin, polyethylene (PE), polypropylene (PP), polyurethane (PU), fluorinated ethylene propylene (FEP), and combinations thereof, but are not limited thereto. In addition, examples of the biodegradable polymer material includes polylactic acid (PLA), polyhydroxybutyrate (PHB), cellulose acetate, poly-epsilon-caprolactone (PCL), polyglycolic acid (PGA), polyhydroxyalkanoate (PHAs) and starch-based thermoplastic resins, but are not limited thereto.

In detail, the cooling element 331 may be made of pure polylactic acid alone. For example, the cooling element 331 may be a three-dimensional structure shape produced by using one or more fiber strands (hereinafter referred to as 'fiber strands') made of pure polylactic acid. Here, the thickness, length, number, and shape of the fiber strands constituting the cooling element 331 may vary. As the cooling element 331 is made of pure polylactic acid, a specific material may be prevented from being generated in a process of passing the aerosol through the cooling element 331.

The second hollow tube 332 may be a cellulose acetate filter. The second hollow tube 332 may be a tube-shaped structure including a second hollow 372 therein. In other words, the second hollow tube 332 may include the second hollow 372 having a diameter D2, and the second hollow 372 may serve as a channel through which the aerosol passes.

The length of the second hollow tube 332 may be an appropriate length within the range of 4 mm to 10 mm, but is not limited thereto. Preferably, the length of the second hollow tube 332 may be about 7 mm, but is not limited thereto. For example, the length of the second hollow tube 332 may be shorter than the length of the first hollow tube 331, but is not limited thereto. As another example, the length of the second hollow tube 332 may be shorter than or equal to the length of the cooling element 331, but is not limited thereto.

The diameter (D2) of the second hollow 372 may be an appropriate diameter within the range of 3 mm to 5 mm, but is not limited thereto. Preferably, a diameter D2 of the second hollow tube 332 may be 4 mm, but is not limited thereto. More preferably, the diameter D2 of the second hollow tube 332 may be the same or larger than the diameter D1 of the first hollow tube 331, but is not limited thereto. That is, a ratio of the diameter D2 of the second hollow tube 332 to the diameter D1 of the first hollow tube 331 may be equal or greater than 1.0, but is not limited thereto.

The filter portion 34 is disposed at a rear end portion that contacts the user's mouth during smoking. A length of the filter portion 34 may be a suitable value in the range of 4 mm to 20 mm. For example, the length of the filter portion 34 may be about 12 mm, but is not limited thereto.

In the process of manufacturing the filter portion 34, a flavoring liquid may be sprayed onto the filter unit 34 such that the filter portion 34 generates a flavor. Alternatively, a separate fiber coated with the fragrance liquid may be inserted into the filter portion 34. The aerosol generated in the medium portion 31 is cooled as the aerosol passes through the cooling portion 33, and the cooled aerosol is delivered to the user through the filter portion 34. Accordingly, when a flavoring element is added to the filter portion 34, there may be an effect of enhancing a persistence of flavor delivered to a user.

Also, the filter portion 34 may include at least one capsule 35. Here, the capsule 35 may have a structure in which the content liquid containing a flavoring is wrapped with a film. For example, the capsule 35 may have a spherical or cylindrical shape.

The aerosol-generating article 3 may be packaged by at least one wrapper 36. The wrapper 36 may have at least one hole through which external air may be introduced or internal air may be discharged. For example, the aerosol-generating article 3 may be packaged by one wrapper 36. As another example, the aerosol-generating article 3 may be double-packaged by at least two wrappers 36.

For example, the medium portion 31 may be wrapped by a first wrapper 361, the first hollow tube 32 may be wrapped by a second wrapper 362, the cooling element 331 may be wrapped by a third wrapper 363, the second hollow tube 332 may be wrapped by a fourth wrapper 364, and the filter portion 34 may be wrapped by the sixth wrapper 366. The cooling element 331 and the second hollow tube 332 wrapped by individual wrappers may be rewrapped by a fifth wrapper 365. The cooling element 331 and the second hollow tube 332 wrapped by the individual wrappers are not necessarily rewrapped by the fifth wrapper 365, and may not be rewrapped by the fifth wrapper 365. In addition, the medium portion 31, the first hollow tube 32, the cooling element 331, the second hollow tube 332, and the filter portion 34 may be combined, and an entire aerosol-generating article 3 may be rewrapped by a seventh wrapper 367.

As another example, the medium portion 31 may be wrapped by the first wrapper 361, the first hollow tube 32 may be wrapped by the second wrapper 362, the cooling element 331 may be wrapped by the third wrapper 363, and the filter portion 34 may be wrapped by the sixth wrapper 366. The cooling element 331 wrapped by the individual wrapper and the second hollow tube 332 not wrapped by the individual wrapper may be wrapped by the fifth wrapper 365. The cooling element 331 and the second hollow tube 332 are not necessarily wrapped by the fifth wrapper 365 and may not be wrapped by the fifth wrapper 365. In addition, the medium portion 31, the first hollow tube 32, the cooling element 331, the second hollow tube 332, and the filter portion 34 may be combined, and the entire aerosol-generating article 3 may be rewrapped by the seventh wrapper 367.

As described above, the cooling portion 33 of the aerosol-generating article 3 includes the cooling element 331 and the second hollow tube 332. That is, the total length of the cooling portion 33 is equal to the sum of the length of the cooling element 331 and the length of the second hollow tube 332. In general, because the manufacturing cost of the cooling element 331 is higher than the manufacturing cost of the second hollow tube 332, the longer the length of the cooling element 31 in the entire length of the cooling unit 33 is, the higher the manufacturing cost of the aerosol-generating article 3 may be. In order to reduce the cost of the aerosol-generating article 3, a short cooling element 331 may be used. However, if the cooling element 331 is too short, the cooling portion 33 may not be able to cool aerosol properly, so a cooling element 331 should have an appropriate length.

In addition, as the aerosol generated in the medium portion 31 is cooled in the cooling portion 33, the particle size increases. As the diameter D2 of the second hollow 372 decreases, the probability that the aerosol having an increased particle size collides with the second hollow tube 332 increases. If the aerosol collides with the second hollow tube 332, some ingredients are absorbed by the second hollow tube 332, thus the aerosol generated in the medium 31 may not be sufficiently delivered to the user. For this reason, the second hollow 372 of the second hollow tube 332 should have a suitable diameter.

Table 1 is a table comparing the ingredients and temperatures of the aerosol discharged from the aerosol-generating article 3 according to an example experiment. The total length of the cooling portion 33 used in this experiment is 14 mm, and the inner diameter D1 of the first hollow tube 32 is 3.4 mm. Experiments were performed on the case where the cooling portion 33 was composed only of the cooling element 331 and the case where the cooling portion 33 was composed of the cooling element 331 having a length of 7 mm and the second hollow tube 332 having a length of 7 mm and an inner diameter D2 of 4 mm.

TABLE 1

| | Ingredients of aerosol (mg) | | | | Temperature of aerosol (° C.) | |
|---|---|---|---|---|---|---|
| | TPM* | Nicotine | Glycerin | Moisture | Maximum temperature | Average temperature |
| Cooling element of 14 mm length | 45.08 | 0.96 | 3.18 | 30.72 | 82.1 | 65.3 |
| Cooling element of 7 mm length + Second hollow tube of 7 mm length and 4 mm inner diameter | 44.89 | 0.98 | 3.36 | 30.16 | 81.4 | 65.0 |

*TPM: total particulate matter According to Table 1, when comparing the case where the length of the cooling element 331 is 14 mm and the case where the cooling element 331 is 7 mm, the ingredients and temperatures of the discharged aerosol in both cases have similar values. That is, it may be seen that the desired cooling effect may be obtained even if the entire length 14 mm of the cooling portion 33 is composed of the cooling element 331 having a length of 7 mm and the second hollow tube 332 having a length of 7 mm. In addition, even if the inner diameter D2 of the second hollow tube 332 is greater than the inner diameter D1 of the first hollow tube 32, it may be seen that the ingredients of the aerosol may be sufficiently delivered to a user.

Table 2 is a table comparing the ingredients of the aerosol discharged from the aerosol-generating article 3 according to an example experiment. The total length of the cooling portion 33 used in this experiment is 14 mm, and the inner diameter D1 of the first hollow tube 32 is 3.4 mm. Experiments were performed on the case where the entire cooling portion 33 was composed of the cooling element 331 and the case where the cooling portion 33 was composed of the cooling element 331 having a length of 7 mm and the second hollow tube 332 having a length of 7 mm and an inner diameter (D2) of 3.4 mm.

TABLE 2

| | Ingredients of aerosol (mg) | | | |
|---|---|---|---|---|
| | TPM | Nicotine | Glycerin | moisture |
| Cooling element of 14 mm length | 40.43 | 1.00 | 3.46 | 26.39 |
| Cooling element of 7 mm length + Second hollow tube of 7 mm length and 3.4 mm inner diameter | 40.48 | 0.94 | 3.05 | 26.80 |

According to Table 2, when comparing the case where the entire cooling portion 33 is composed of the cooling element 331 and the case where the cooling portion 33 is composed of a cooling element 331 having a length of 7 mm and a second hollow tube 332 having a length of 7 mm and an inner diameter D2 of 3.4 mm, the ingredients of the discharged aerosol in both cases have similar values. In other words, even if the inner diameter D2 of the second hollow tube 332 has the same size as the inner diameter D1 of the first hollow tube 32, it may be seen that ingredients of the aerosol may be sufficiently delivered to a user. According to Table 1 and Table 2, it may be seen that the cooling effect may be maintained even if the cooling portion 33 further includes the second hollow tube 332, in addition to the cooling element 331. Also, even if the inner diameter D2 of the second hollow tube 332 is greater than or equal to the inner diameter D1 of the first hollow tube 32, it may be seen that ingredients of the aerosol may be sufficiently delivered to a user.

Accordingly, the cooling portion 33 may be configured to include the cooling element 331 and the second hollow tube 332, thereby reducing manufacturing cost while maintaining the aerosol ingredient delivery function and cooling function of the aerosol-generating article 3.

Figure 4:
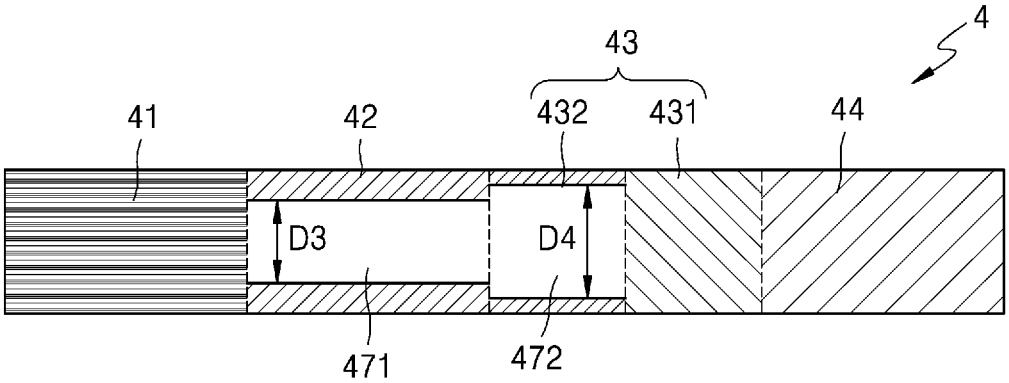

FIG. 4 is a diagram showing another example of an aerosol-generating article.

Referring to FIG. 4, the aerosol-generating article 4 includes a medium portion 41, a first hollow tube 42, a cooling portion 43, and a filter portion 44.

Compared to the aerosol-generating article 3 shown in FIGS. 2 and 3, the aerosol-generating article 4 shown in FIG. 4 has the reverse order in which the cooling elements 431 and the second hollow tube 432 are arranged. The other configuration is the same as the aerosol-generating article 3 shown in FIGS. 2 and 3.

Table 3 is a table comparing the ingredients and temperatures of the aerosol discharged from the aerosol-generating article 4 according to an example experiment. The total length of the cooling portion 43 used in this experiment is 14 mm, and an inner diameter D3 of the first hollow tube 42 is 3.4 mm. Experiments were conducted on the case where the entire cooling portion 33 is composed of the cooling element, the case where the cooling portion 33 is composed of the cooling element 331 having a length of 7 mm and the second hollow tube 332 having a length of 7 mm and an inner diameter D2 of 4 mm according to the arrangement shown in FIG. 3, and the case where the cooling portion 43 is composed of the cooling element 431 having a length of 7 mm and the second hollow tube 432 having a length of 7 mm and an inner diameter D4 of 4 mm according to the arrangement shown in FIG. 4.

TABLE 3

| | Ingredients of aerosol (mg) | | | | Temperature of aerosol (° C.) | |
|---|---|---|---|---|---|---|
| | TPM | Nicotine | Glycerin | Moisture | Maximum temperature | Average temperature |
| Cooling element of 14 mm length | 45.08 | 0.96 | 3.18 | 30.72 | 82.1 | 65.3 |
| Cooling element of 7 mm length + Second hollow tube of 7 mm length and 4 mm inner diameter + Arrangement of cooling element and second hollow tube as shown in FIG. 3 | 44.89 | 0.98 | 3.36 | 30.16 | 81.4 | 65.0 |
| Cooling element of 7 mm length + Second hollow tube of 7 mm length and 4 mm inner diameter + Arrangement of cooling element and second hollow tube as shown in FIG. 4 | 43.37 | 0.80 | 2.42 | 28.63 | 85.0 | 65.9 |

Based on Table 3, an experimental result of a case (hereinafter, referred to as a first case) where the cooling element 331 is disposed on the upstream side and the second hollow tube 332 is disposed on the downstream side as shown in FIG. 3 is compared with an experimental result of a case (hereinafter, referred to as a second case) where the cooling element 431 is disposed on the downstream side and the second hollow tube 432 is disposed on the upstream side as shown in FIG. 4.The amount of the discharged nicotine is 0.98 mg in the first case and 0.80 mg in the second case was 0.80 mg. That is, and the amount of nicotine delivered to a user in the second case is reduced by about 18% when compared to the first case. In addition, the maximum temperature and the average temperature of the aerosol discharged in the second case are 85.0° C. and 65.9° C., respectively, which are higher than the maximum temperature 81.4° C. and the average temperature 65.0° C. of the aerosol discharged in the first case.

Accordingly, it may be seen that when compared with the case where the cooling element 431 is disposed on the downstream side and the second hollow tube 432 is disposed on the upstream side as shown in FIG. 4, the case where the cooling element 331 is disposed on the upstream side and the second hollow tube 332 is disposed on the downstream side as shown in FIG. 3 may provide a better smoking quality to the user.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present invention is shown in the claims rather than the foregoing description, and all differences within the equivalent range should be construed as being included in the present invention.

What is claimed is:

1. An aerosol-generating article comprising:

a medium portion configured to accommodate a first susceptor of an induction heater within the medium portion;

a first hollow tube disposed to face a downstream end of the medium portion and including a first hollow;

a cooling portion disposed next to a downstream side of the first hollow tube, and including a cooling element and a second hollow tube including a second hollow;

a filter portion disposed to face a downstream end of the cooling portion, wherein a flavoring liquid is sprayed on the filter portion, and the filter portion comprises a capsule having a spherical or cylindrical shape and containing a content liquid wrapped in a film;

a wrapper wrapping at least a portion of the medium portion, the first hollow tube, the cooling portion, and the filter portion; and a heat conductive material surrounding the medium portion and configured to function as a second susceptor of an induction heater, wherein an entire surface of an upstream end of the medium portion is exposed to an outside of the aerosol-generating article so that air is introduced through the entire surface of the upstream end in a longitudinal direction of the aerosol-generating article, the entire surface of the upstream end of the medium portion has a same diameter as at least one of the cooling element or the filter portion, wherein the second hollow tube further includes cellulose acetate, wherein the cooling element and the second hollow tube are sequentially arranged downstream, wherein a length of the first hollow tube is 10 mm, wherein each of a length of the second hollow tube and a length of the cooling element is 7 mm, wherein a length of the filter portion is 12 mm, wherein the diameter of the first hollow is 3.4 mm and the diameter of the second hollow is 4 mm, and wherein the wrapper comprises:

at least one hole through which external air is introduced and internal air is discharged;

a first wrapper, a second wrapper, a third wrapper, and a fourth wrapper that individually wrap the medium portion, the first hollow portion, the cooling element, and the second hollow tube, respectively;

a fifth wrapper that rewraps the cooling element and the second hollow tube that are individually wrapped by the third wrapper and the fourth wrapper;

a sixth wrapper that individually wraps the filter portion; and a seventh wrapper that rewraps the entire aerosol-generating article which is wrapped by the first wrapper to the sixth wrapper.

2. The aerosol-generating article of claim 1, wherein a length of the second hollow tube is shorter than a length of the first hollow tube.

3. The aerosol-generating article of claim 1, wherein the first hollow tube includes cellulose acetate.

4. The aerosol-generating article of claim 1, wherein the cooling element includes a polymer fiber.

* * * * *